United States Patent [19]

Czerwinski

[11] 4,101,736

[45] Jul. 18, 1978

[54] DEVICE FOR INCREASING THE COMPLIANCE OF A SPEAKER ENCLOSURE

[75] Inventor: Eugene J. Czerwinski, Studio City, Calif.

[73] Assignee: Cerwin Vega, Inc., Los Angeles, Calif.

[21] Appl. No.: 844,709

[22] Filed: Oct. 25, 1977

Related U.S. Application Data

[63] Continuation-in-part of Ser. No. 778,429, Mar. 17, 1977, abandoned.

[51] Int. Cl.[2] ..... H04R 1/28

[52] U.S. Cl. ..... 179/1 E; 181/151

[58] Field of Search ..... 181/151; 179/1 E

[56] References Cited

U.S. PATENT DOCUMENTS

| | | | |
|---|---|---|---|
| 2,718,931 | 9/1955 | Boudouris | 181/149 |
| 3,385,929 | 5/1968 | Magyar et al. | 181/145 |
| 4,044,855 | 8/1977 | Kobayashi | 181/151 |

*Primary Examiner*—George G. Stellar
*Attorney, Agent, or Firm*—W. Edward Johansen

[57] ABSTRACT

The present invention is a device for use in combination with a loudspeaker system, that includes a speaker enclosure, in order to effectively enlarge the volume of the speaker enclosure. The loudspeaker system also includes a vibratable cone. The device for effectively enlarging the volume of the speaker enclosure includes a gas having a gamma less than 1.4 and the product of its density and the square of the speed of sound therein less than the same product for air and a bag which is formed from a soft, pliable material for enclosing the gas within the speaker enclosure and which is adapted to seal the gas therein. The device also includes an acoustically transparent and porous cocoon which is disposed about the bag so that it surrounds completely the bag and an acoustical padding which is disposed adjacent to the sidewalls of the speaker enclosure and which is adapted to enclose the acoustically transparent and porous cocoon. The device may also include a device for generating the gas by heating a fluid in its liquid phase so that the fluid changes to its gas phase. The device for heating the fluid may either be a resistive electrical element which is disposed within the speaker enclosure or fibrous, sound absorbent material which is disposed within the bag. The device is placed in the speaker enclosure in back of the vibratable cone in order to increase the compliance that the vibratable cone sees.

6 Claims, 5 Drawing Figures

DEVICE FOR INCREASING THE COMPLIANCE OF A SPEAKER ENCLOSURE

This patent application is a continuation-in-part application of a U.S. Pat. application filed by the inventor on Mar. 17, 1977, having Ser. No. 778,429 and entitled A Device For Increasing the Compliance of a Speaker Enclosure, now abandoned.

BACKGROUND OF THE INVENTION

1. Field of the Invention

The present invention relates to a loudspeaker system and more particularly to a device for effectively enlarging the volume of a speaker enclosure of the loudspeaker system in order to increase the compliance that a vibratable cone of the loudspeaker system sees.

2. Description of the Prior Art

The fundamental physics of the pressure variations in a sound wave are discussed in Mechanics, Heat and Sound by Francis Weston Sears wherein on page 498 he sets out the following equation:

$$v^2 = (\gamma)(p/\rho),$$

where $v$ is the speed of sound in a gas, ($\gamma$) is the ratio, $C_p/C_v$ of the specific heat of the gas at a constant pressure, $C_p$, to the specific heat of the gas at a constant volume, $C_v$, $p$ is the pressure of the gas, and ($\rho$) is the density of the gas.

In Applied Acoustics, Harry F. Olsen and Frank Massa discuss a back enclosed cone of a loudspeaker system on pages 197 and 198, the following is an excerpt from that discussion:

"In general cone speakers are used with both sides of the cone open so that radiation into the air takes place from both sides. For certain uses, as for example a standard source of sound for microphone calibration, reverberation measurement, it is desirable to enclose the speaker mechanism in a box and thus confine the radiation from the cone. The important factor in this system is the stiffness introduced by the box. The net result of this added stiffness is an attenuation of the low-frequency response. A specific example will illustrate the important factors in this system."

In the specific example, the velocity of the cone is given by the equation:

$$\dot{x} = \frac{f_M}{r_M + j\omega m + \frac{1}{j\omega C_M}},$$

where $f_M$ = Bli = B(flux density in the air gap) l (length of wire in the voice coil) $i$ (current in the voice coil), $r_M$ = radiation resistance, $m$ = mass of the cone, voice coil and air load, $C_M = C_{M1} + C_{M2} = C_{M1}$ (compliance of center and suspension system of the cone) + $C_{M2}$ (compliance of the box enclosing the back of the cone), $C_{M2}$ = V (volume of the box)/$A^2$ (the square of the area of the cone) ($\rho$) (the density of air) $c^2$ (the square of the velocity of sound in air). Another excerpt from Applied Acoustics follows:

"From a consideration of the equation it will be seen that above the resonant frequency the velocity of the system is inversely proportional to the frequency; therefore, since $r_M$ is proportional to the square of the frequency the power output will be independent of the frequency. Below the resonant frequency the velocity is limited by the compliances $C_{M1}$ and $C_{M2}$ and the velocity of the cone is practically proportional to the frequency, which means that the response is rapidly attenuated with decreasing frequency. Therefore, the low-frequency response limit will be determined by the resonance frequency of the system. If $C_{M2}$ is large compared to $C_{M1}$, then the compliance of the box will not materially affect the response and the action will be practically the same as that with both sides open to the air. If the resulting volume when the condition is satisfied is too large and cumbersome, then the system must be altered. Since the mass of the cone is practically proportional to the area and its interaction with the compliance $C_{M2}$ is inversely proportional to the square of the area, we can reduce the resonance frequency by reducing the area of the cone." A reduced area will require an increased excursion for equal power resulting in increased distortion.

U.S. Pat. No. 3,905,448, entitled Loudspeaker, issued to Hirotake Kawakami, Toshio Sasabe, Toshio Hirosawa, Nobuyuki Arakawa, Kozo Kokubu, Kazumasa Abe and Toshiko Harashino on Sept. 16, 1975 teaches a loudspeaker of a general type having a vibratable cone diaphragm.

U.S. Pat. No. 2,797,766, entitled Loud Speaker, issued to Herbert W. Sullivan on July 2, 1957 an air tight enclosure containing an acoustic diaphragm is provided with a membrane substantially permeable to mechanical vibrations, but substantially impermeable to the gaseous medium on either side of the membrane. The acoustic diaphragm vibrates in a gaseous medium which is heavier than air and in which sound travels at a slower speed than in air. The characteristic impedance of the diaphragm in the gaseous medium and the acoustical capacitance is lower than when compared to those prevailing in air. The difficulty with this air-tight enclosure is that the preferred speaker enclosure has a venting port so that there is a source of high velocity air against the back of the diaphragm of the loudspeaker.

U.S. Pat. No. 4,004,094, entitled Enclosure System For Sound Generators issued to James H. Ott on Jan. 18, 1977, teaches a device for use in an enclosure associated with an audio speaker which permits relatively large volume changes within the enclosure as a result of relatively small pressure changes so that relatively small enclosures can be effective as enclosures of larger volume. The device reduces the energy required from the speaker to change the volume of the interior of the enclosure. Pressure perturbations caused by the movement of the vibratorily driven membrane of the sound producing device cause alternate condensation and vaporization of the composition to minimize backpressure. This gas-liquid equilibrium is the key to the operation of this device. The patent teaches an improved sound production system which has a less than perfectly sealed enclosure with a flexibly walled container contained therein. The container has an expansible and contractible volume and contains a composition of matter having an equilibrium state between a gas phase and a liquid phase.

Loudspeakers presently in use are of the acoustical suspension design and require a large amount of power. There is a movement toward more efficient loudspeakers because individuals are demanding more volume with less distortion than typical low efficiency speakers can deliver with amplifiers of moderate size. The superpowered amplifiers in home music systems require several hundred watts of amplifier power in order to achieve faithful reproduction of modern recordings with low efficiency speakers. These speakers are unable to hold up under this deluge of amplifier power and they eventually break down. There is therefore a need for a high efficiency speaker that will require less power for lifelike reproduction of modern recordings.

SUMMARY OF THE INVENTION

In view of the foregoing factors and conditions characteristic of the prior art it is an object of the present invention to provide a device for a loudspeaker system that increases the effective volume for low frequencies of its speaker enclosure.

It is another object of the present invention to provide a device for a loudspeaker system that increases the compliance that its vibratable cone sees for a particular volume of its speaker enclosure.

It is still another object of the present invention to provide a device for a loudspeaker system that enables the speaker enclosure to be reduced in volume and to still retain its efficiency at low frequencies.

In accordance with an embodiment of the present invention a device for use in combination with a loudspeaker system, that includes a speaker enclosure, in order to effectively enlarge the volume of the speaker enclosure has been described. The loudspeaker system also includes a vibratable cone. The device for effectively enlarging the volume of the speaker enclosure includes a gas having a gamma less than 1.4 and the product of its density and the square of the speed of sound therein less than the same product for air and a bag which is formed from a soft, pliable material for enclosing the gas within the speaker enclosure and which is adapted to seal the gas therein. The device also includes an acoustically transparent and porous cocoon which is disposed about the bag so that it surrounds completely the bag and an acoustical padding which is disposed adjacent to the sidewalls of the speaker enclosure and which is adapted to enclose the acoustically transparent and porous cocoon. The device may also include a device for generating the gas by heating a fluid in its liquid phase so that the fluid changes to its gas phase. The device for heating the fluid may either be a resistive electrical element which is disposed within the speaker enclosure or fibrous, sound absorbent material which is disposed within the soft, pliable membrane. The device is placed in the speaker enclosure in back of the vibratable cone in order to increase the compliance that the vibratable cone sees.

The features of the present invention which are believed to be novel are set forth with particularity in the appended claims.

Other objects and many of the attendant advantages will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
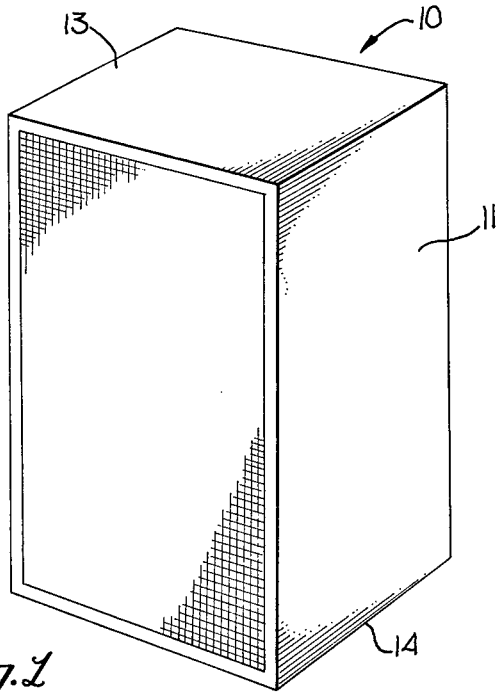
FIG. 1 is a perspective view of a loudspeaker system that has a speaker enclosure of the vented box type and that has a device for effectively enlarging the volume of the speaker enclosure which is constructed in accordance with the principles of the present invention.

The present invention can best be understood by reference to a description of its preferred embodiment and to the showings in the drawing. The invention is an improvement for use in combination with a loudspeaker system 10 shown in FIG. 1 to effectively enlarge the volume of a speaker enclosure 11 so that its vibratable cone 12 sees a larger compliance than it sees without the improvement.

Figure 2:
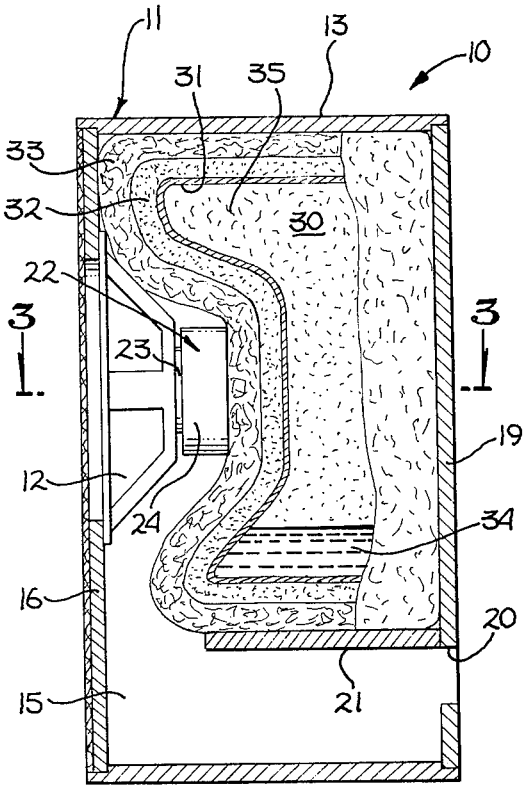
FIG. 2 is a side elevational view of the speaker enclosure of FIG. 1 showing the device for effectively enlarging its volume.

Referring now to FIG. 2, the speaker enclosure 11 includes a top 13, a bottom 14, a pair of sides 15 and a front 16 having a speaker port. The loudspeaker system 10 includes a vibratable cone 12 having an open apex which is disposed within the speaker port. The side cross-sectional view of the speaker enclosure 11 also reveals that its back 19 has a port opening 20 and a planar baffle 21 parallelly disposed with respect to the bottom wall. A standard loudspeaker which is described in U.S. Pat. No. 3,917,914, entitled Loudspeaker, issued to Rollin James Parker on Nov. 4, 1975 and which is also described in any one of a number of patents covering loudspeakers includes in addition to the vibratable cone 12 a ring magnet 22 positioned in its peripheral circular surface within and in solid contact with the apex of the vibratable cone 12, a magnet circuit 23 positioned within the ring of the magnet 22, but not in direct contact therewith, with the magnet 22 extending interiorly of the vibratable cone 12, an electromagnetic coil 24 mounted on the magnetic circuit 23 and a device for positioning the vibratable cone 12, the ring magnet 22, the magnetic circuit 23 and the electromagnetic coil 24 whereby the ring magnet 22 and the vibratable cone 12 are vibratable in response to an electrical signal impressed on the electromagnetic coil 24.

Figure 3:
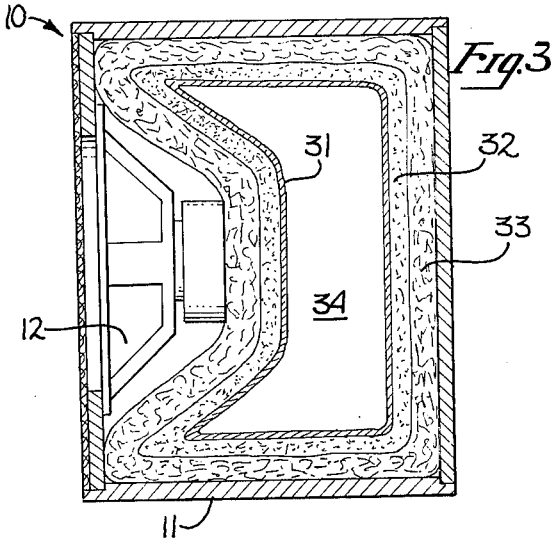
FIG. 3 is a vertical cross-sectional view of the speaker enclosure of FIG. 1 taken along line 3—3 of FIG. 2.

Still referring to FIG. 2 the improvement to the loudspeaker system 10 is the use of a gas 30 that has a gamma ($\gamma$), $C_p/C_v$, less than 1.4 and the product of its density ($\rho$) and the square of the speed of sound ($c$), ($\rho$) $c^2$, less than the same product for air. The gas 30 is enclosed within the speaker enclosure 11. The enclosed volume of a vented loudspeaker system 10 of the Helmholtz resonator type will determine the low frequency conversion efficiency of the loudspeaker system 10 if the bandwidth is held constant. An increase in the effective volume therefore will result in an increased efficiency in practice because the optimum volume of such an enclosure is very large relative to practical realizations. Such an increase in the effective volume is obtained in adiabatic compression by use of an enclosed vapor with a gamma less than 1.4. The gas 30 is enclosed in a bag 31 which is formed from a soft, pliable membrane and which is adapted to seal the gas 30 therein. The bag 31 is generally formed from a laminated nylon or some other polymeric material. The bag 31 is disposed behind the vibratable cone 12 within the speaker enclosure 11 and fills most of the inner volume thereof. Referring to FIG. 3 in conjunction with FIG. 2 one can see how the bag 31 is disposed within the speaker enclosure 11. The bag 31 is disposed within an acoustically transparent and porous cocoon 32 which completely surrounds it. The acoustically transparent and porous cocoon 32 is disposed within an acoustical padding 33 which covers the top, the bottom, the sides and the front of the enclosure 11 so that it completely surrounds the acoustically transparent and porous cocoon 32.

The acoustically transparent and porous cocoon allows the sound pressure waves to act upon the bag 31 over its entire surface by preventing the bag 31 from laying flat against the hard interior of the enclosure 11. The fact that the bag 31 is formed from a soft, pliable membrane necessitates the use of the cocoon 32, but the use of the soft, pliable bag enables one to reduce to the practice the theoretical advantages of the loud speaker taught in U.S. Pat. No. 2,797,766, entitled Loud Speaker issued to Herbert W. Sullivan on July 2, 1957 and the enclosure system taught by U.S. Pat. No. 4,004,094, entitled Enclosure System for Sound Generators, issued to James H. Ott on Jan. 18, 1977. One of the reasons that the cocoon 32 is necessary is that the bag 31 in the cocoon 32 does not block the vent or duct in a vented cabinet. A second reason is that it is virtually impossible to seal a vibratable piston and cabinet from gas diffusing out therefrom for more than a few hours. A third reason is that the cocoon 32 allows uniform cabinet pressure to impinge on all surfaces of the bag 31. The fourth reason is that the bag 31 would vibrate, chafe and rupture if it came into contact with the sharp edges of the cabinet. The cocoon 32 does not allow the bag 31 to come into contact with the edges of the cabinet.

Still referring to FIG. 2 in conjunction with FIG. 3 the bag 31 is adapted to enclose a fluid 34 which is in its liquid phase and a fibrous, sound absorbent material 35 disposed within the bag 31 for heating the fluid 34 by excitation and changing the fluid 34 from its liquid phase to its gas or vapor phase.

Figure 5:
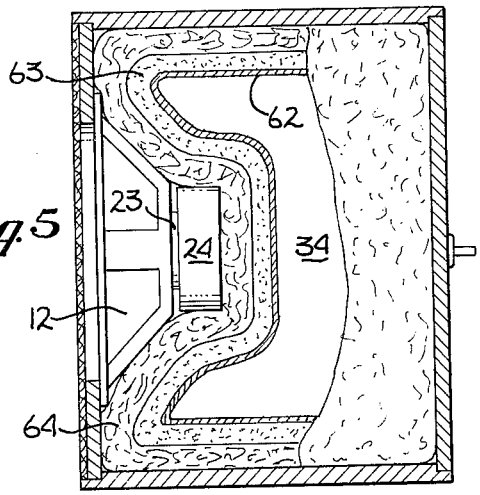
FIG. 5 is a vertical cross-sectional view of the speaker enclosure of FIG. 4 taken along line 5—5.
Figure 4:
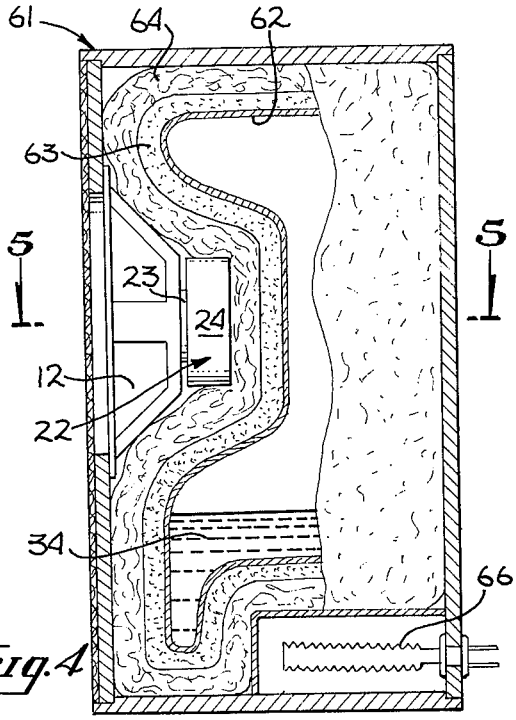
FIG. 4 is a side cross-sectional view of a speaker enclosure of the sealed box type.

Referring now to FIG. 4 in conjunction with FIG. 5 a cross-sectional view of a second speaker enclosure 61 has a bag 62 in a cocoon 63 within acoustical padding 64. The speaker enclosure 61 has a resistence element 66 which serves the same function as the fibrous, sound absorbent material 35 in FIG. 2.

According to F. K. Moore, author of "Effect of Radiative Transfer on a Sound Wave in a Gas having ($\gamma$) near One", in the Physics of Fluid, Volume 9, Number 1, page 70, Jan. 1966 weak sound waves propagating in rather transparent gas which is at a sufficiently high temperature are dispersed by radiative heat transfer. In Fluid Dynamics of Multiphase Systems, S. L. Soo describes a gas-liquid system and condensation on page 309 thereof. According to Mr. Soo the speed of sound in a gas in water system is slower than in pure water. Mr. Soo also stated that the speed of sound in a mixture of gas and liquid is much slower when compared with that in either the gas or the liquid because the gas acted as a weak spring which is coupled mechanically to the water as a large mass. Referring to the reference from Applied Acoustics the compliance of the speaker enclosure is determined by one divided by the product of the square of the speed of sound in the gas and the density of the gas. Therefore the compliance is increased as a result of the lower speed of sound. The vapor is generated in the soft, pliable membrane 31 by the sound, which is generated by the movement of the vibratable cone 12, being absorbed by the fibrous, sound absorbent material 35 and thereby becoming energy in the form of heat which causes the fluid 34 in its liquid phase to change to its vapor or gaseous phase.

In one of the preferred embodiments the fibrous sound absorbent material 35 is fiberglass which is loosely contained in the bag 31. The fluid 34 is Freon 11 which has a boiling point near room temperature, 74.8° F.

The gas 30 or fluid 34 which may be used may be a flurocarbon such as Freon 11, Freon 113 and Freon 114 or any gas or fluid which has a gaseous state with a gamma less than 1.4, such as carbon-dioxide ($CO_2$), and a compliance factor which is larger than the compliance factor for air [$1/(\rho)c^2$]. In TABLE I, which is set out below, several appropriate compounds are listed with their physical properties that make them useful in the present invention.

TABLE I

| Compound | Boiling Point | Density | Speed of Sound | Gamma | Compliance Factor |
|---|---|---|---|---|---|
| Freon 11 | 74.8° F | $5.86 \frac{gm}{lit.}$ | $469 \frac{ft}{sec}$ | 1.137 | $1.29 \times 10^6$ |
| Freon 113 | 117° F | $7.38 \frac{gm}{lit.}$ | $390 \frac{ft}{sec}$ | 1.080 | $1.12 \times 10^6$ |
| Freon 114 | 38.2° F | $7.83 \frac{gm}{lit.}$ | $411 \frac{ft}{sec}$ | 1.084 | $1.32 \times 10^6$ |
| Air | | $1.29 \frac{gm}{lit.}$ | $1130 \frac{ft}{sec}$ | 1.4 | $1.65 \times 10^6$ |

From the foregoing it can be seen that a device for effectively enlarging the volume of a speaker enclosure has been described. The device is used in combination with a loudspeaker system to increase the compliance that a vibratable cone sees. Furthermore, it should be noted that the schematics of the device have not been drawn to scale and that distances of and between the figures are not to be considered significant.

Accordingly, it is intended that the foregoing disclosure and showings made in the drawing shall be considered as illustrations of the principles of the present invention.

What is claimed is:

1. In a loudspeaker system an improvement for use in combination with a loudspeaker system which includes:

a. a vibratable cone having an open apex; and b. a speaker enclosure having a top, a bottom, a back, a pair of sides and a front, the front having a speaker opening wherein the vibratable cone is mechanically coupled so that it may vibrate in response to an electrical signal, said improvement is a device for effectively enlarging the volume of the speaker enclosure in order to increase the compliance that the vibratable cone sees with said device comprising:

a. a gas having a gamma value less than 1.4 and the product of its density and the square of speed of sound therein less than the same product for air; and b. a bag formed from a soft, pliable material for enclosing said gas within the speaker enclosure and adapted to seal said gas therein and to seal atmospheric gases and water thereout;

c. an acoustically transparent and porous cocoon disposed about said bag so that it surrounds completely said bag; and d. an acoustical padding disposed adjacent to the top, the bottom, the back, the sides and the front of the enclosure and adapted to enclose said acoustically transparent and porous cocoon.

2. In a loudspeaker system an improvement for use in combination with a loudspeaker system according to claim 1 wherein said gas is produced by heating a fluid in its liquid phase and said device also comprises means for heating said fluid.

3. In a loudspeaker system an improvement for use in combination with a loudspeaker system according to claim 2 wherein said means for heating said fluid is a fibrous, sound absorbent material disposed within said bag and adapted to heat said fluid by excitation created by sound pressure changes.

4. In a loudspeaker system an improvement for use in combination with a loudspeaker system according to claim 2 wherein said means for heating said fluid is a resistive electric element which is disposed within said bag and which utilizes externally supplied electrical energy.

5. An improvement for use with a loudspeaker system according to claim 2 wherein said means for heating said fluid is a resistive electric element which is disposed without said bag and which utilizes externally supplied electrical energy.

6. In a loudspeaker system an improvement for use in combination with a loudspeaker system which includes:

a. a vibratable cone having an open apex; and b. a speaker enclosure having a top, a bottom, a back, the back having a venting opening to provide a direct air path to the rear of the vibratable cone, a pair of sides and a front, the front having a speaker opening wherein the vibratable cone is mechanically coupled so that it may vibrate in response to an electrical signal, said improvement is a device for effectively enlarging the volume of the speaker enclosure in order to increase the compliance that the vibratable cone sees with said device comprising:

a. a gas having a gamma value less than 1.4 and the product of its density and the square of speed of sound therein less than the same product for air; and b. a bag formed from a soft, pliable material for enclosing said gas within the speaker enclosure and adapted to seal said gas therein and to seal atmospheric gases and water thereout;

c. an acoustically transparent and porous cocoon disposed about said bag so that it surrounds completely said bag; and d. an acoustical padding disposed adjacent to the top, the bottom, the back, the sides and the front of the enclosure and adapted to enclose said acoustically transparent and porous cocoon so that said bag, said cocoon and said padding does neither interfere nor close off the direct air path to the venting opening from the rear of the vibratable cone.

* * * * *